US006194690B1

(12) United States Patent
Vilato et al.

(10) Patent No.: US 6,194,690 B1
(45) Date of Patent: Feb. 27, 2001

(54) COOKING APPLIANCE

(75) Inventors: Pablo Vilato, Paris; Michel Grassi, La Ferte Sous Jouarre, both of (FR)

(73) Assignee: Eurokera, Chierry (FR)

( * ) Notice: Subject to any disclaimer, the term of this patent is extended or adjusted under 35 U.S.C. 154(b) by 0 days.

(21) Appl. No.: 09/576,908

(22) Filed: May 23, 2000

Related U.S. Application Data

(63) Continuation of application No. 09/233,449, filed on Jan. 20, 1999.

(30) Foreign Application Priority Data

Jan. 20, 1998 (FR) ..... 98 00536

(51) Int. Cl.[7] ..... H05B 3/68; F24C 3/00
(52) U.S. Cl. ..... 219/460.1; 126/393
(58) Field of Search ..... 219/450.1, 452.11, 219/452.12, 460.1, 461.1, 463.1, 464.1, 465.1; 126/39 H, 39 K, 90 A, 92 A, 211, 217

(56) References Cited

U.S. PATENT DOCUMENTS

| | | | | |
|---|---|---|---|---|
| 2,172,469 | * | 9/1939 | Grigas | 126/220 |
| 3,632,983 | * | 1/1972 | Dills | 219/452.12 |
| 3,830,216 | * | 8/1974 | Dood | 126/214 A |
| 4,145,603 | * | 3/1979 | Mackay et al. | 219/387 |
| 5,139,007 | * | 8/1992 | Martinez | 126/39 J |
| 5,347,609 | * | 9/1994 | Huff | 219/452.11 |

* cited by examiner

*Primary Examiner*—Sang Paik
(74) *Attorney, Agent, or Firm*—Oblon, Spivak, McClelland, Maier & Neustadt, P.C.

(57) ABSTRACT

A cooking appliance containing at least one substantially flat top plate and at least one cooking heat source. The plate is provided with at least one concavity under which there is placed the cooking heat source.

26 Claims, 2 Drawing Sheets

COOKING APPLIANCE

CROSS-REFERENCE TO RELATED APPLICATIONS

This application is a continuation of Ser. No. 09/233,449, the entire content of which is hereby incorporated by reference, and claims priority to French Application No. 98/00536 filed Jan. 20, 1999.

BACKGROUND OF THE INVENTION

1. Field of the Invention

The present invention relates to a cooking appliance containing a substantially flat top plate and at least one cooking heat source.

2. Discussion of the Background

In the field of equipment items intended for home use, evolutions of appliances used in the kitchen have been constant and considerable during recent years, driven by esthetic technical demands.

The design of cooking appliances has undergone numerous modifications. Thus, enameled-sheet stoves using natural-gas or LPG burners as cooking heat sources have been known for many years. The advantages offered by such stoves, related directly to the nature of the aforesaid cooking heat sources, are very familiar: flexibility of use, low thermal inertia, immediate visibility of heating-power adjustments. The drawbacks of these stoves are also well known, such as the presence of a frame-shaped metal grid which must be cleaned frequently.

Moreover, the esthetic appeal of these stoves appears to be increasingly losing favor, even with the recent use of a molded glass plate on which the gas burners are placed.

Cooking tops commonly known as "electric plates" and using electric resistances disposed under circular metal plates as cooking heat sources have also been long known. These cooking tops have the basic advantage of no longer having metal grids, since the cooking utensils are placed directly on the aforesaid heating plates.

Concurrently with the introduction of the integrated kitchen concept, a major change has been made in cooking tops. This change has consisted in using plates of glass-ceramic These plates, which are now widely used, enjoy two notable advantages among others, specifically the ease of cleaning (because of the fact that the surface of a glass-ceramic plate is basically flat) and a strikingly novel external appearance, giving them a more modern appeal.

In addition, these cooking plates of glass-ceramic material have been combined with new cooking heat sources such as halogen lamps and induction heat sources.

In parallel with the aforesaid changes made to cooking appliances, the design of cooking utensils has also undergone numerous modifications.

In particular, cooking vessels of the pan or casserole type, although they have retained their primary function of reheating and/or cooking the food contained therein, have undergone considerable evolution in their external appearance and structure.

Some of these modifications have been driven solely by forces of esthetic nature (color, decorative pattern).

Other modifications can be related to the fact that cooking heat sources have also evolved both in their dimensions (dimensions defining the active heating part) and in their nature (halogen-lamp heat sources, induction heat sources).

For example, casserole dishes or pans of ferromagnetic material, which can be adapted to induction heat sources, have been developed.

However, there now exists a need to improve the compatibility between, on the one hand, the parts of cooking appliances other than the cooking heat sources themselves (radiant or halogen-lamp heating element, gas burner, inductor) and, on the other hand, the cooking vessels.

In fact, imperfect compatibility can lead to various drawbacks during use.

In the particular case of cooking tops, the use of specific vessels, for example having large dimensions and/or a particular surface condition, can be difficult on glass-ceramic cooking plates.

For example, it may prove difficult precisely to center the vessels, especially of large dimensions, perpendicular to the cooking heat sources disposed underneath the plate, with the result that their bottom not necessarily being heated homogeneously over their entire surface.

Similarly, from the fact that the vessels are not necessarily limited in their displacement relative to the plate, or in other words they are not confined to a precise zone thereof, they may create surface scratches, which may be harmful to the mechanical resistance of the plate under certain circumstances. From a safety viewpoint, this can sometimes prove dangerous in that unaware persons, for example children, manipulating these same hot vessels may cause them without excessive effort to slide over the plate and finally cause them to fall from the cooking top in question.

SUMMARY OF THE INVENTION

The object of the invention is therefore to overcome the aforementioned drawbacks and to provide in particular a cooking appliance for home use which makes it possible to position all existing cooking vessels with sufficient precision while limiting their displacement by an unaware person.

Another object of the invention is to provide a cooking appliance for home use which makes it possible to obviate the use of a cooking vessel.

These objects are achieved according to the invention by a cooking appliance containing at least one basically flat top plate and at least one cooking heat source, characterized by the fact that the said plate contains at least one concavity under which the said cooking heat source is placed.

It is stipulated that the expression "cooking heat source" must be understood within the scope of the invention as any heating element such as, but not restricted to, a radiant element or a gas burner and/or any element associated with heating, such as an inductor associated with an induction heater.

According to one advantageous characteristic of the invention, the cooking heat source is a heating element. This heating element may be of the radiant or halogen-lamp type. The term "radiant" is to be understood as comprising an electric resistance, such as a metal conducting wire or a conductive layer of adequate resistivity such as that described in French Utility Certificate FR/U 2744116. Such conductive layer may be advantageous when it is preferable for the cooking appliance according to the invention to retain overall dimensions comparable to those of a prior art cooking appliance of the same type, or in other words a cooking appliance not containing a concavity according to the invention. This may be the case in particular in the configurations in which the concavity has nonnegligible depth.

The heating element according to the invention is preferably calibrated to a maximum temperature on the order of 450° C. This makes it possible to achieve direct cooking of all types of foods in the concavity according to the invention without risk of excessive overheating.

It is also possible to couple the heating element with two temperature limiters, which are configured to limit the maximum temperatures at about 400° C. and about 580° C. respectively. These temperatures being established at the concavity surface.

In this configuration, the user has the option of cooking foods directly on the concavity surface or by means of classical cooking utensils.

To regulate the heating power of the heating element, it is preferable to use a thermostat operated by measurement of the temperature between the plate and the cooking heat source under consideration. This makes it possible to avoid the use of an energy meter which imposes a ratio between the times of the on and off states.

According to a preferred embodiment, the heating element advantageously has an annular form and is placed in the peripheral portion under the concavity.

According to an advantageous characteristic of the invention, the plate can be of glass ceramic material.

According to another advantageous characteristic of the invention, the concavity itself is of glass-ceramic material.

Such a plate can then be of the glass-ceramic type whose appearance is in harmony with the kitchen furniture such as described in International Patent Application WO 98/01676.

Advantageously, the plate according to the invention may additionally contain at least one opening in which there is inserted a gas burner of atmospheric type and/or at least one flat heating zone under which there is placed another cooking heat source, such as a heating element or induction heat source. Under this configuration, the cooking appliance according to the invention is a hybrid, since it comprises at least two different heat sources providing direct and indirect heat transfer. Such a configuration allows the user to cook and/or reheat foods as desired, in particular by allowing for certain criteria such as the nature of the foods and possibly the type of vessels available.

According to this same configuration, the plate comprises at least two neighboring modules, one of the two having at least one concavity and the other having at least one opening and/or at least one flat heating zone. This modular configuration of the plate is extremely advantageous, more particularly in the case in which the cooking appliance constitutes a cooking top integrated with the kitchen furniture.

In fact, by virtue of the "integrated" kitchen concept, the final user can make choices at several levels. In addition to the choice of desired furniture and its arrangement, it will now be possible to choose the nature of the cooking heat sources which make up the cooking top and the manner in which they are arranged therein.

Preferably the modules are joined together by a mechanical device, thus preventing infiltration of all liquid and/or solid particles which may be present on each of the modules. This device is advantageously a seal, preferably resistant to high temperature and impervious, of the silicone-seal type.

Two alternatives can be envisioned for the joint between the concavity and the plate: the concavity may be removably mounted to the plate or integrated with the plate. The first alternative can be chosen, for example, when foods to be cooked and/or reheated in the concavity according to the invention are mainly of liquid type. In this alternative, the person skilled in the art will be careful, once the concavity has been removed from the plate, to provide in particular a leakproof cover as well as electrical insulation of satisfactory safety, more particularly in conformity with the standards in force applicable to home electrical appliances.

Preferably, the concavity according to the invention has a flat bottom, advantageously parallel to the plane of the plate. It is thus more convenient to place a cooking vessel in the concavity when this technique is preferable. This flat bottom may advantageously be circular. Such a bottom has the advantage of not presenting any sharp edge which makes the concavity more difficult to clean. Preferably, this circular flat plate has a diameter of between about 100 mm and about 400 mm. Such a range permits the potential use of all existing cooking vessel standards According to an additional characteristic, the transmission $T_L$ and/or $T_{IR}$ of the flat bottom for wavelengths in the visible and/or infrared spectrum respectively may be different from that of the rest of the plate, and preferably less than at least 10%. In other words, the flat bottom transmits infrared and visible light at an intensity level which is at least 10% less than a level transmitted by a remaining of the plate. Such a characteristic is advantageous from an esthetic viewpoint, in that the concavity can be endowed with an appearance contrasting with that of the rest of the plate, which is commonly transparent brown.

According to another characteristic of the invention, the upper peripheral rim is raised relative to the plane of the plate.

According to yet another characteristic of the invention, the depth p of the concavity is between about 20 mm and about 80 mm. With such a characteristic, the cooking appliance retains correct overall dimensions and the concavity has a useful cooking volume relative to the quantity of foods to be cooked and/or reheated.

According to a preferred variant, the concavity according to the foregoing is covered with a bell. Preferably, this permits visual inspection. The bell can have a glass or glass-ceramic wall. When covered in this way, the concavity permits the user to achieve "steam" cooking of foods contained in the vessel placed inside the concavity or contained directly in the concavity.

Advantageously, the bell is provided with a sheet of ferromagnetic material and at least one inductor is placed under the concavity, preferably in its peripheral portion.

When the inductor is turned on, it produces a magnetic field and thus acts as a magnet. Once the heating element and the inductor are turned on, the manner in which the foods are cooked resembles that of an "oven". In fact, the foods are cooked not only directly and/or reheated through the bottom of the concavity but also from above by means of the bell, which becomes a heating element by virtue of the inductor.

In addition, such a cooking method is particularly adapted to the new culinary customs in cooking. In fact, it permits rapid and efficient cooking of prepared elements of the frozen type.

When the concavity is not used as a heating zone, it may advantageously be covered with a board, such as a wooden board. This is preferably of complementary form over at least part of the depth of the concavity.

The user of the cooking appliance then has available a working surface on which the foods can be directly prepared.

Such an "integrated" working surface constitutes a gain of space in the kitchen, since the user does not have to provide therein a place specifically reserved for food preparation.

The cooking appliance just described is perfectly adapted for constituting a cooking top or part of a stove. In other words, another embodiment of the invention corresponds to a stove including a cooking top comprising a substantially flat top plate and a cooking heat source, wherein the plate includes at least one concavity under which the cooking heat source is placed.

BRIEF DESCRIPTION OF THE DRAWINGS

Other advantageous details and characteristics of the invention will become clear hereinafter from the description of an illustrative but non-limitative embodiment, provided with reference to the figures, wherein.

DESCRIPTION OF THE PREFERRED EMBODIMENTS

Figure 1:
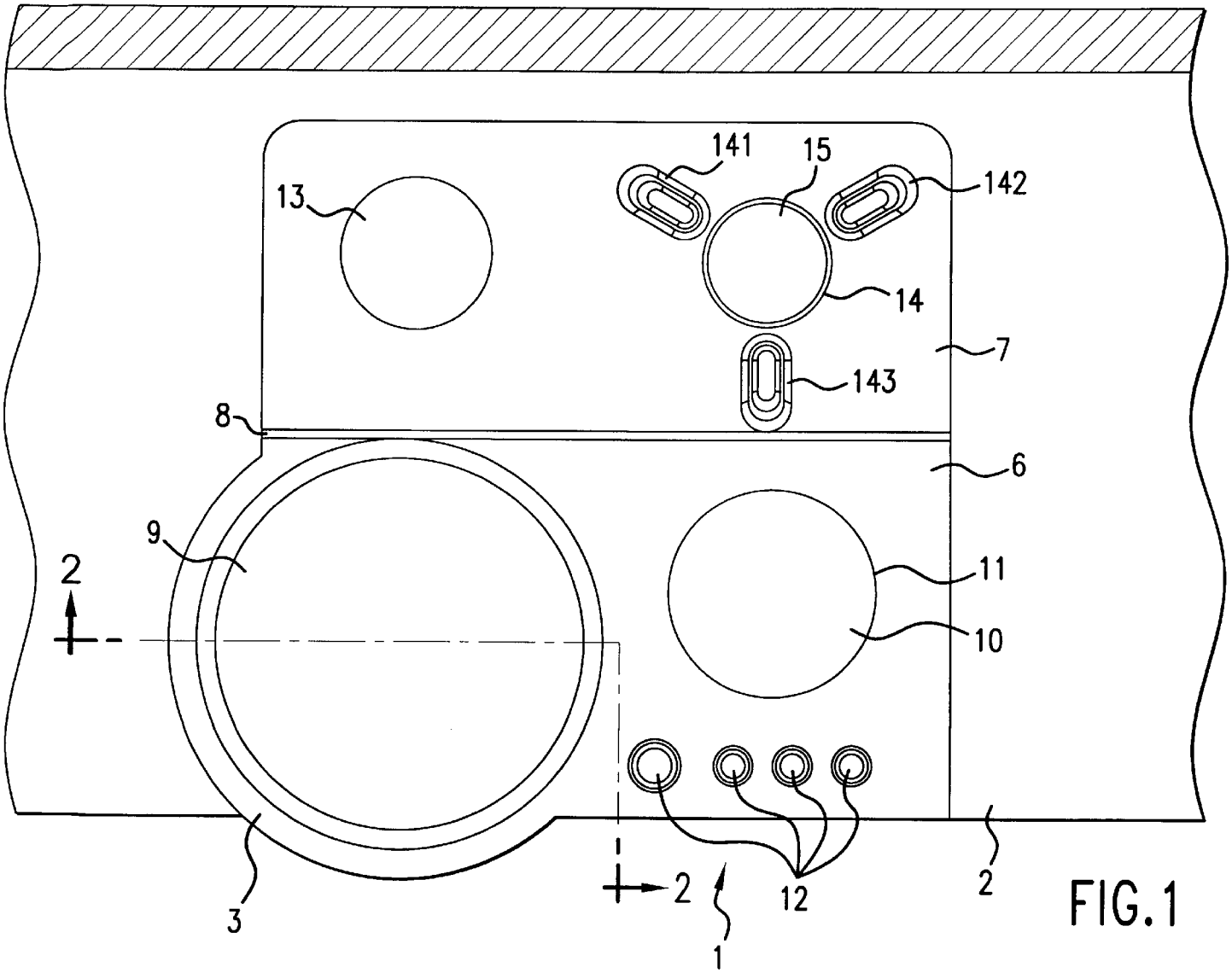
FIG. 1 shows a cooking top according to the invention integrated with the kitchen furniture.

FIG. 1 shows a cooking top 1 integrated with a kitchen cabinet 2. This cooking top 1 comprises a cooking plate 3 of glass-ceramic material, substantially flat and smooth, resting on a metal frame 4 (FIG. 2) on which there are fixed four cooking heat sources 5 (FIG. 2).

The glass-ceramic cooking plate 3 is made up of two neighboring modules 6, 7 joined together by a silicone seal 8, which is resistant to high temperature and impervious.

The first module 6 contains an integrated concavity 9, beside which there is disposed a flat circular heating zone 10 defined in a manner known in itself by a white enamel line 11. In its marginal zone it also has sensing keys 12, which are activated by the proximity of a finger. The sensing keys 12 constitute respective control elements configured to control the four cooking heat sources 5 fixed under plate 3. The second module 7 also contains a circular flat heating zone 13 as well as an opening 14, in which there is inserted a gas burner 15 constituting one of the four cooking heat sources 5. Around the opening 14 there are disposed three bumps 141, 142, 143 designed to support a cooking vessel whose contents are is to be heated by burner 15. These bumps are obtained in accordance with the technique described in International Patent Application WO 97/00407.

The other cooking heat sources 5 are made up on the one hand of two heating elements, not shown, each containing a halogen lamp placed respectively under the two flat circular heating zones 10, 13, and a heating element 5, shown in FIG. 2, comprising an electric resistance 16 in the form of an assembly of metal conducting wires 17.

FIG. 2 is a sectional view along the axis 2—2 of the concavity 9 integrated with the aforesaid first module 6. This concavity 9 has a flat bottom 18, parallel to the plane of plate 3 and of circular diameter on the order of 300 mm. The depth P of concavity 9 is approximately equal to 50 mm. Its upper peripheral rim is raised relative to the plane of plate 3.

Figure 2A:
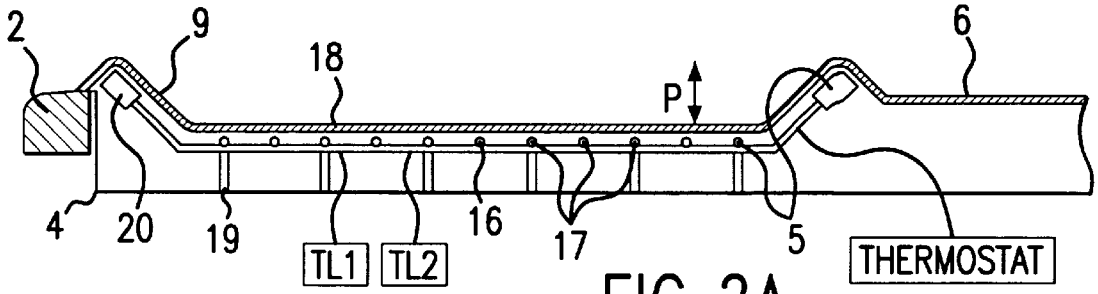
FIG. 2A shows a sectional view along axis 2—2 of a portion of the cooking top according to FIG. 1.

Immediately under the flat bottom 18 of concavity 9 there is placed an electric resistance 16 in the form of an assembly 17 of cylindrical metal conducting wires, arranged such that, when supplied with current, it homogeneously heats the entire circular surface of the said bottom 18. Also shown in FIG. 2A is a thermostat connected to regulate the heating element 5, and two temperature limiters TL1 and TL2, coupled to the heating element 5 and configured to limit the temperature of the concavity surface to about 400° C. and about 580° C. respectively.

This assembly 17 of metal wires is fixed to a support 19 of ceramic materials, itself mounted in the metal frame 4 of cooking top 1.

At the lower periphery of the concavity there is mounted an inductor 20 such that it is clamped with the ceramic support 19.

Figure 2B:
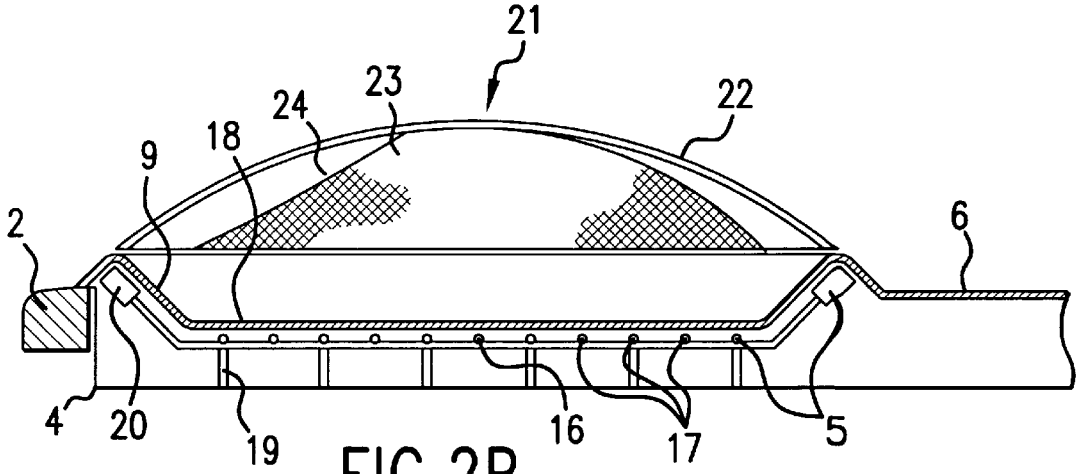
FIGS. 2B and 2C show a sectional view along axis 2—2 of this same portion, covered respectively with a bell and a wooden board.

FIG. 2B shows that the concavity is covered with a bell 21 which has an outer wall 22 of glass ceramic and on the inside a sheet 23 of ferromagnetic material allowing visual inspection via its opening 24. The sheet 23 of ferromagnetic material constitutes the other portion of the induction-heating means completed by inductor 20.

During its design, the person skilled in the art will take care to ensure that its structure is such that, once inductor 20 is turned on, the "heating" currents passing through it are sufficient to ensure minimum heating power inside the enclosure defined precisely by bell 21 and concavity 9.

In particular, for ease of industrial fabrication and mounting inside bell 21, he will take care to construct this sheet 23 in one single piece.

The cooking method of this assembly is "free" and depends on whether or not electric resistance 16 and inductor 20 are operating simultaneously.

Figure 2C:
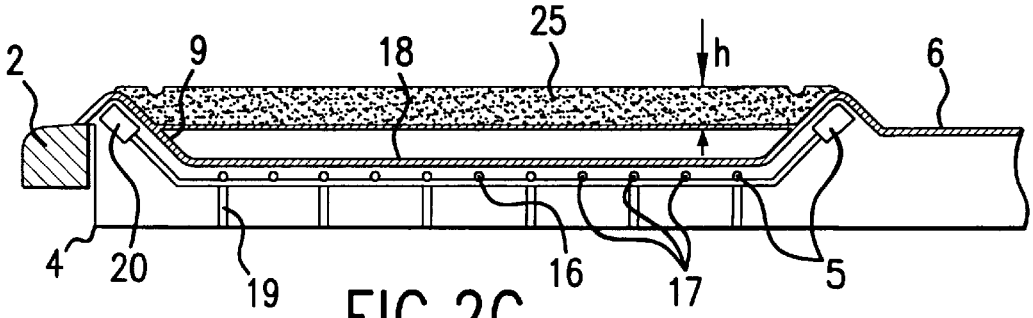

Finally, FIG. 2C shows that, when neither of these elements 16, 20 is operating, the concavity can be covered by a wooden board 25 of complementary shape over a height h of 30 mm.

To validate the direct cooking function achieved according to the invention, different cooking tests, using exclusively electric resistance 16, have been performed on several types of foods placed directly in concavity 9.

Table 1 below indicates, for each type of food, the range of temperatures in ° C. used to achieve cooking as well as the necessary time in minutes.

When oil was used to cook the food under consideration, this is indicated in parentheses.

TABLE 1

| Examples | Types of Food | Range of cooking temperature (° C.) | Time necessary for cooking (minutes) |
|---|---|---|---|
| 1 | Pork scallop (oil) | 350–400 | 6 minutes for 150 g of meat |
| 2 | Pork scallop | 350–400 | 6 minutes for 150 g of meat |
| 3 | Leg of lamb (oil) | 350–400 | 8 minutes for 200 g of meat |
| 4 | Chopped beef (oil) | 350–400 | 8 minutes for 150 g of meat |
| 5 | Chopped beef | 350–400 | 6 minutes for 150 g of meat |
| 6 | Chipolatas (oil) | 210–250 | 20 minutes for 6 sausages |
| 7 | Chipolatas | 210–250 | 20 minutes for 6 sausages |
| 8 | Tomatoes (oil) | 250–280 | 12 to 18 minutes for 8 slices |
| 9 | Tomatoes | 250–280 | 12 to 18 minutes for 8 slices |
| 10 | Onions (oil) | 250–280 | 18 minutes for 4 slices |
| 11 | Onions | 250–280 | 18 minutes for 4 slices |
| 12 | Crepes | 200 | 3 to 4 minutes per crepe |

The concavity was then cleaned after three batches of each type of food had been cooked, except for the chipolatas, in which case cleaning was performed after each batch of 6 sausages had been cooked.

The products used were firstly a product commonly used to clean dishware and secondly the product sold under the trademark Kiraviv™, which is usually used for cleaning glass-ceramic plates.

In parallel with cleaning, the severity index of each type of food was recorded. This index is representative of the difficulty involved in cleaning the food under consideration and therefore its tendency to cause stains. It is pointed out here that the value of the severity index increases with the difficulty of the cleaning operation. It is also pointed out that the severity indices were recorded after 20 kg of each type of food had been cooked.

Table 2 below presents the cleaning operations performed and the severity index for the same types of foods as listed in Table 1.

TABLE 2

| Examples | Product(s) used for cleaning | Severity index |
|---|---|---|
| 1 | Kiraviv ™ then dishware cleaner | 0.003 |
| 2 | Kiraviv ™ then dishware cleaner | 0.003 |
| 3 | Kiraviv ™ then dishware cleaner | 0.003 |
| 4 | Kiraviv ™ then dishware cleaner | 0.003 |
| 5 | Kiraviv ™ then dishware cleaner | 0.003 |
| 6 | Kiraviv ™ then dishware cleaner | 0 |
| 7 | Kiraviv ™ then dishware cleaner | 0 |

TABLE 2-continued

| Examples | Product(s) used for cleaning | Severity index |
|---|---|---|
| 8 | Dishware cleaner | 0 |
| 9 | Dishware cleaner | 0 |
| 10 | Dishware cleaner | 0 |
| 11 | Dishware cleaner | 0 |
| 12 | Dishware cleaner | 0 |

From these tables it is clear that direct cooking of foods on a glass-ceramic plate proposed by the invention as well as the associated cleaning does not pose any problem.

Quite obviously it goes without saying that diverse modifications can be made without going beyond the scope of the invention.

For example, the inductor 20 can be replaced by a heating element, thus permitting cooking of "steam" type.

Obviously, numerous modifications and variations of the present invention are possible in light of the above teachings. It is therefore to be understood that within the scope of the appended claims, the invention may be practiced otherwise than as specifically described herein.

This application is filed based on French Patent Application No. 98/00536 filed Jan. 20, 1998 and incorporated herein as reference.

What is claimed is:

1. A cooking appliance comprising:

a substantially flat top plate having a concavity; and a cooking heat source placed under said concavity, wherein the top plate is of glass-ceramic material, and the concavity is configured to directly receive food so that said food is cooked directly on said top plate.

2. An appliance according to claim 1, wherein the cooking heat source is a heating element.

3. An appliance according to claim 2, wherein said heating element is calibrated to a maximum temperature on the order of 450° C.

4. An appliance according to claim 2, further comprising two temperature limiters coupled to said heating element and configured to limit a temperature of the concavity surface to about 400° C. and about 580° C. respectively.

5. An appliance according to claim 2, further comprising a thermostat connected for regulating said heating element.

6. An appliance according to claim 2, wherein said heating element has an annular form and is placed in a peripheral portion under the concavity.

7. An appliance according to claim 1, wherein the concavity is of glass-ceramic material.

8. An appliance according to claim 1, further comprising a gas burner located in an opening of the top plate.

9. An appliance according to claim 8, wherein the top plate comprises a first module including the concavity and a second module including the gas burner, said first and second modules being joined to each other.

10. An appliance according to claim 1, further comprising a flat heating zone under which is placed a second cooking heat source.

11. An appliance according to claim 10, wherein the top plate comprises a first module including the concavity and a second module including the flat heating zone, said first and second modules being joined to each other.

12. An appliance according to claim 9, wherein said first and second modules are joined together by a mechanical device configured to prevent infiltration.

13. An appliance according to claim 11, wherein said first and second modules are joined together by a mechanical device configured to prevent infiltration.

14. An appliance according to claim 12, wherein said mechanical device comprises a silicon seal resistant to high temperature and impervious.

15. An appliance according to claim 13, wherein said mechanical device comprises a silicon seal resistant to high temperature and impervious.

16. An appliance according to claim 1, wherein the concavity is integrated with the top plate.

17. An appliance according to claim 1, wherein the concavity is removably mounted to the top plate.

18. An appliance according to claim 1, wherein the concavity has a flat bottom parallel to a plane of the top plate.

19. An appliance according to claim 18, wherein the flat bottom of the concavity is circular, with a diameter of between about 100 mm and about 400 mm.

20. An appliance according to claim 18, wherein the flat bottom transmits infrared and visible light at an intensity level which is at least 10% less than a level transmitted by a remaining of the plate.

21. An appliance according to claim 1, further comprising an upper peripheral rim raised relative to a plane of the top plate.

22. An appliance according to claim 1, wherein a depth of the concavity is between about 20 mm and about 80 mm.

23. An appliance according to claim 1, further comprising a bell configured to cover the concavity and to permit visual inspection of the inside of the bell, said bell comprising a convex outer wall and a concave inner wall.

24. An appliance according to claim 23, wherein said outer wall of the bell comprises a member of the group consisting of glass and glass-ceramic.

25. An appliance according to claim 23, wherein said inner wall of the bell comprises a sheet of ferromagnetic material.

26. An appliance according to claim 1, further comprising a board configured to cover the concavity and having a shape complementary to a shape of the concavity over at least part of a depth of the concavity.

* * * * *